US011047270B2

(12) United States Patent
Altherr et al.

(10) Patent No.: US 11,047,270 B2
(45) Date of Patent: Jun. 29, 2021

(54) VALVE TRAIN OF AN INTERNAL COMBUSTION ENGINE

(71) Applicant: Mahle International GmbH, Stuttgart (DE)

(72) Inventors: Patrick Altherr, Stuttgart (DE); Thorsten Ihne, Stuttgart (DE); Rolf Kirschner, Esslingen (DE); Mario Mohler, Stuttgart (DE); Markus Walch, Bretten (DE)

(73) Assignee: Mahle International GmbH

( * ) Notice: Subject to any disclaimer, the term of this patent is extended or adjusted under 35 U.S.C. 154(b) by 0 days.

(21) Appl. No.: 16/817,597

(22) Filed: Mar. 12, 2020

(65) Prior Publication Data

US 2020/0291829 A1 Sep. 17, 2020

(30) Foreign Application Priority Data

Mar. 13, 2019 (DE) ..... 102019203432.2

(51) Int. Cl.
*F01L 13/00* (2006.01)
*F01L 1/047* (2006.01)
(Continued)

(52) U.S. Cl.
CPC ..... *F01L 13/0036* (2013.01); *F01L 1/047* (2013.01); *F01L 1/181* (2013.01); *F01L 1/267* (2013.01);
(Continued)

(58) Field of Classification Search
CPC ... F01L 2001/0473; F01L 1/053; F01L 1/181; F01L 1/267; F01L 2013/0052; F01L 2305/02
(Continued)

(56) References Cited

U.S. PATENT DOCUMENTS 8,191,524 B2 6/2012 Elendt et al.
9,103,243 B2 8/2015 Hartlieb et al.
(Continued)

FOREIGN PATENT DOCUMENTS

DE 102008028513 A1 12/2009
DE 102009053116 A1 9/2010
(Continued)

OTHER PUBLICATIONS

English abstract for DE-102013111476.
(Continued)

*Primary Examiner* — Jorge L Leon, Jr.
(74) *Attorney, Agent, or Firm* — Fishman Stewart PLLC

(57) ABSTRACT

A valve train may include a camshaft, a cam sleeve adjustable in an axial direction between first and second positions and non-rotatably arranged on the camshaft, a first cam and at least one second cam, a pin and at least one cam follower mounted thereon, a guide contour arranged on the cam sleeve and having first and second guide tracks, and a control pin optionally engaging in the first or second guide track to adjust the cam sleeve between the first and second positions. The at least one cam follower in the first and second positions may interact respectively with the first and second cams. On the camshaft or an internal surface of the cam sleeve, first and second snap-in recesses and a third snap-in recess therebetween may be arranged. A snap-in device having a snap-in element preloaded into the snap-in recesses may be provided, the snap-in recess fixing the cam sleeve in the first or second position. The first and second guide tracks may intersect in an intersection region. Between the first and third snap-in recesses and between the second and third snap-in recesses, first and second snap-in humps may respectively be arranged. The snap-in element may engage in the third snap-in recess when the control pin is in the intersection region.

12 Claims, 5 Drawing Sheets

(51) Int. Cl.
*F01L 1/18* (2006.01)
*F01L 1/26* (2006.01)
*F01L 1/053* (2006.01)

(52) U.S. Cl.
CPC ..... *F01L 1/053* (2013.01); *F01L 2001/0473* (2013.01); *F01L 2013/0052* (2013.01); *F01L 2305/02* (2020.05)

(58) Field of Classification Search
USPC ..... 123/90.16, 90.17, 90.18, 90.27, 90.39, 123/90.44
See application file for complete search history.

(56) References Cited

U.S. PATENT DOCUMENTS

2010/0224154 A1* 9/2010 Elendt ..... F01L 13/0036 123/90.17
2012/0285408 A1* 11/2012 Richter ..... F01L 13/0036 123/90.17
2015/0204219 A1* 7/2015 Takagi ..... F01L 13/0036 123/90.18
2019/0003353 A1 1/2019 Hirschmann et al.

FOREIGN PATENT DOCUMENTS

DE 102013111476 A1 4/2015
DE 102014010635 A1 1/2016
DE 102016124851 A1 6/2018
EP 3421741 A1 1/2019
JP 2013-234601 A 11/2013

OTHER PUBLICATIONS

English abstract for DE-102016124851.
English abstract for JP2013-234601.
English abstract for DE-102014010635.

* cited by examiner

VALVE TRAIN OF AN INTERNAL COMBUSTION ENGINE

CROSS-REFERENCE TO RELATED APPLICATIONS

This application claims priority to German Patent Application Number DE 10 2019 203 432.2, filed on Mar. 13, 2019, the contents of which are hereby incorporated by reference in their entirety.

TECHNICAL FIELD

The present invention relates to a valve train of an internal combustion engine having a camshaft and having a first cam and a second cam arranged axially adjacent thereto. In addition, the invention relates to a camshaft and to a cam sleeve for such a valve train.

BACKGROUND

Generic valve trains of an internal combustion engine are known, which on a camshaft comprise at least one first and at least one second cam for a valve control. Likewise known are rocker lever assemblies having a shifting pin that is adjustable in the axial direction between at least two positions, on which at least one cam roller is mounted axially fixed yet rotatable at the same time. The shifting pin is mounted in associated bearing eyes of the rocker lever assembly, wherein the cam rollers follow a cam profile of the first or second cam. On the camshaft proper, a guide contour having a first guide track and a second guide track is arranged, wherein a shifting of the shifting pin is effected via a control pin which is arranged in the shifting pin and optionally engages in the first or second guide track and because of this adjusts the shifting pin between its two positions, in which the associated cam roller interacts either with the first cam or the second cam. Thus, the cam roller interacts in a first position of the shifting pin with the first cam, i.e. a first cam profile of the same, and in a second position of the shifting pin with the second cam. Usually, a first snap-in recess and a second snap-in recess arranged in the axial direction of the shifting pin axially adjacent thereto is usually arranged on the shifting pin, wherein the shifting pin is fixed in the first or the second position in that a snap-in device engages with a snap-in element preloaded into the first or the second snap-in recess.

The two guide tracks of the guide contour can run independently of one another, wherein in this case usually an actuation device is provided, which actuates the control pin or the control pins on the shifting pin thereby pressing these into the first guide track or the second guide track.

Guide contours having two guide tracks, which intersect in an intersection region and because of this are referred to as x-guide contour would also be possible. By way of this, a substantial optimisation potential compared with adjusting systems having separate guide tracks, would be achievable in particular with a view to an installation space and a cost optimisation through a reduction of the component number, combined with the position, logistics and assembly costs connected with this. Such x-guide contours however are not usually employed in practice since in the intersection region of the two guide tracks there is a region without guidance through a respective associated groove flank and because of this a collision with the land separating the guide track branches or a threading of the control pin into the wrong guide track can occur. In the first case, there is a risk of damaging or destroying the control pin while in the second case a change of the operating mode is not possible.

Since the control pin in this case is not guided in the intersection region, the friction of the shifting components (cam sleeve or shifting pin) is a main influence factor for a successful adjustment besides an engine rotational speed (defined initial speed). In the variable valve train systems known from the prior art, the assembly to be shifted, i.e. for example an axially adjustable shifting pin or a cam sleeve, is held in associated snap-in recesses, for example grooves by way of spring-loaded snap-in elements, for example spheres, which positively define the end positions where they hold the respective adjustable element, i.e. for example the cam sleeve or the shifting pin. There, a cylindrical region in which the spring preloading the snap-in element into the associated snap-in recesses is subjected to the greatest load is located between the snap-in recesses, from which a major friction upon the adjustment results, which in particular renders a switching by means of x-groove at least more difficult.

Disadvantageous with the known variable valve train systems thus is a high friction during the adjusting, a major installation space requirement and high costs resulting from this.

SUMMARY

The present invention therefore deals with the problem of stating an improved or at least an alternative embodiment for a valve train of the generic type, which overcomes the disadvantages known from the prior art.

According to the invention, this problem is solved through the subject of the independent claims. Advantageous embodiments are subject of the dependent claims.

The present invention is based on the general idea of providing a snap-in contour on a camshaft (1st alternative) or on an internal surface of a cam sleeve (2nd alternative) axially adjustably arranged on a camshaft and for the same not only with two snap-in recesses axially adjacent to one another, but provide a third snap-in recess between these two snap-in recesses, as a result of which on the one hand the friction during the axial adjustment of the cam sleeve on the camshaft can be minimised without threatening the tight seat of the shifting components, i.e. in the present case of the cam sleeve in its respective positions.

Here, the third snap-in recess is delimited in the axial direction by a first and a second snap-in hump, as a result of which a snap-in element is reliably held between the flanks of the third snap-in recess and in the guided guide track region is pulled over the respective snap-in hump. At the falling flank of the snap-in hump, the control pin is additionally subjected to an additional acceleration through the component of the spring force acting in the axial direction of the camshaft. Additionally provided is a guide contour with guide tracks intersecting in an intersection region, wherein in this intersection region the snap-in element engages in the third snap-in recess and because of this the spring element preloading the snap-in element into the third snap-in recess exerts a lesser force because of a reduced compression, as a result of which the friction can be reduced. Thus, the spring preload is minimal in the intersection region of the two guide tracks, wherein only following the passing of the intersection region the second snap-in hump is overcome. In addition, an installation space optimisation can be achieved through the x-guide contour, as a result of which additional assembly and cost advantages can be realised. The valve train of an internal combustion engine according to the invention comprises a camshaft with the cam sleeve which is adjustable thereon in the axial direction between at least two positions and non-rotatably at the same time, having a first cam and a second cam arranged adjacent thereto. In addition to this, the valve train can have a pin on which at least one cam follower, for example a cam roller, is mounted, wherein the pin can be firmly mounted in the axial direction in associated bearing eyes of the rocker lever assembly. Now, the previously described x-shaped guide contour with a first and a second guide track is arranged on the camshaft, which intersect in an intersection region. A control pin can optionally engage in the first or the second guide track and thereby adjust the cam sleeve between its two end positions. Here, the control pin can be arranged in the pin or separately to the same. In the first end position of the cam sleeve, the at least one cam follower interacts with the cam profile of the first cam and in a second end position of the cam sleeve with the cam profile of the second cam. On the camshaft proper or on the internal surface of the cam sleeve, the first snap-in recess and the second snap-in recess axially adjacent thereto are now provided, wherein a spring-preloaded snap-in element of a snap-in device (either on the cam sleeve side or camshaft side) engages in the first or the second snap-in recess and thereby fixes the cam sleeve in its first or second (end) position. According to the invention, the previously described third snap-in recess is provided between the first snap-in recess and the second snap-in recess arranged axially adjacent thereto, wherein between the first and the third snap-in recess a first snap-in hump and between the second and the third snap-in recess a second snap-in hump are arranged, and wherein the snap-in element in the intersection region of the two guide tracks engages in the third snap-in recess and by way of this reliably guides the control pin over the intersection region without fearing that the same collides with a land separating the two guide tracks or threads into the wrong guide track. With the valve train according to the invention, multiple advantages compared with the variable valve train systems known from the prior art can thus be achieved, which include in particular a reduction of the number of components and thus connected reduction of the stock and logistical costs, a reduction of the assembly expenditure and an installation space optimisation and a reduction of the friction.

Practically, in the second alternative embodiment, the first snap-in recess, the second snap-in recess and the third snap-in recess are formed as annular grooves on the internal surface of the cam sleeve that are open towards the inside, wherein the snap-in device is arranged in an opening crossing the camshaft and comprises a coil spring as well as two spheres. By way of this, both the snap-in recesses and also the snap-in device can be produced in a technically simple and cost-effective manner.

In an advantageous further development of the solution according to the invention, the first snap-in hump and/or the second snap-in hump have a rounded dome. The advantage of a rounded dome is for example a gentler transition and a larger contact area compared with a pointed dome, as a result of which the surface pressure on the snap-in element and thus a wear can be reduced. However, by way of a pointed dome a quick and direct transition between the third snap-in recess and the first or the second snap-in recesses or vice versa is possible.

In a further advantageous embodiment of the solution according to the invention, a flank of the first snap-in hump falling towards the third snap-in recess has a steeper slope than a flank falling towards the first snap-in recess. In addition or alternatively it can also be provided that a flank of the second snap-in hump falling towards the third snap-in recess has a steeper slope than a flank falling towards the second snap-in recess. By way of this and following the overcoming of the first or of the second snap-in hump, an axial shifting of the cam sleeve from the direction of the first or second snap-in recess can be supported and thus the control pin reliably guided in the intersection region of the two guide tracks.

Practically, the snap-in device comprises a sphere that is arranged on the cam sleeve side and spring-preloaded into the second or the third snap-in recess. In this case, the snap-in recesses are arranged on the camshaft side. Such a sphere makes possible on the one hand a low-friction adjusting of the cam sleeve and at the same time also a smooth transition between the individual snap-in recesses.

In a further advantageous embodiment of the solution according to the invention, the third snap-in recess has a greater axial length L than the first snap-in recess and the second snap-in recess. Because of this it is possible to easily guide the control pin in the intersection region of the two guide tracks and at the same time, through the in the axial direction shorter first and second snap-in recess, reliably fix the associated cams in their position interacting with the cam follower. In a further advantageous embodiment of the solution according to the invention, a radial height H of the first and/or second snap-in hump is smaller than a radius R of the camshaft. Because of this, a significantly smaller spring preload is required on the snap-in element for overcoming the first and/or second snap-in hump, as a result of which the adjusting movement can be facilitated and the wear reduced. However, the radial height H of the first and/or second snap-in hump is dimensioned at the same time so that a reliable guidance of the snap-in element in the respective snap-in recess can be made possible and an unintentional changing between two adjacent snap-in recesses avoided.

Practically, the camshaft on its outer surface in the region of the camshaft comprises axial grooves which interact with internal teeth arranged on an internal surface of the cam sleeve and because of this make possible an axial shifting of the cam sleeve on the camshaft. The axial grooves on the camshaft can form an external gearwheel profile, which interacts with an internal gearwheel profile on the cam sleeve formed complementarily thereto in such a manner that the cam sleeve is shiftably arranged in the axial direction on the camshaft but non-rotatably on the same, i.e. is rotatable only together with the same. Obviously, this can also be effected by means of an anti-rotation device which prevents a rotation of the cam sleeve relative to the camshaft, but makes possible an axial shifting of the cam sleeve on the camshaft. Such an anti-rotation device can also comprise a feather key, a polygon profile and the like.

Further, the present invention is based on the general idea of stating a camshaft for the previously described valve train or of such a valve train according to the first alternative which comprises a first snap-in recess and a second snap-in recess adjacent axially thereto and moreover, between these two snap-in recesses, additionally a third snap-in recess, which is separated via a first snap-in hump to the first snap-in recess and via a second snap-in hump to the second snap-in recess. By means of such a camshaft, a guiding contour for a control pin with guide tracks intersecting x-like in an intersection region on a cam sleeve is possible, as a result of which such a camshaft is the basis for the previously described valve train according to the invention.

In an advantageous further development of the camshaft according to the invention, the first snap-in hump and/or the second snap-in hump have a rounded or a pointed dome. The advantage of a rounded dome lies in a gentler transition and in a contact area that is larger compared with that of a pointed dome, as a result of which the surface pressure on the snap-in element and thus a wear can be reduced. However, a quicker and direct transition between the third snap-in recess and the first or the second snap-in recess or vice versa is possible by way of a pointed dome.

In a further advantageous embodiment of the camshaft according to the invention, a radial height H of the first and/or second snap-in hump is smaller than a radius R of the camshaft. Because of this, a significantly lower spring preload on the snap-in element is required for overcoming the first and/or second snap-in hump, as a result of which the adjusting movement can be facilitated and the wear reduced.

Further, the present invention is based on the general idea of stating a cam sleeve for the previously described valve train or of such a valve train according to the second alternative, which on an internal surface comprises a first snap-in recess and a second snap-in recess arranged axially adjacent thereto, wherein between the first snap-in recess and the second snap-in recess a third snap-in recess is provided, wherein between the first and the third snap-in recess a first snap-in hump and between the second and the third snap-in recess a second snap-in hump are arranged.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

BRIEF DESCRIPTION OF THE DRAWINGS

There it shows, in each case schematically

DETAILED DESCRIPTION

Figure 1:
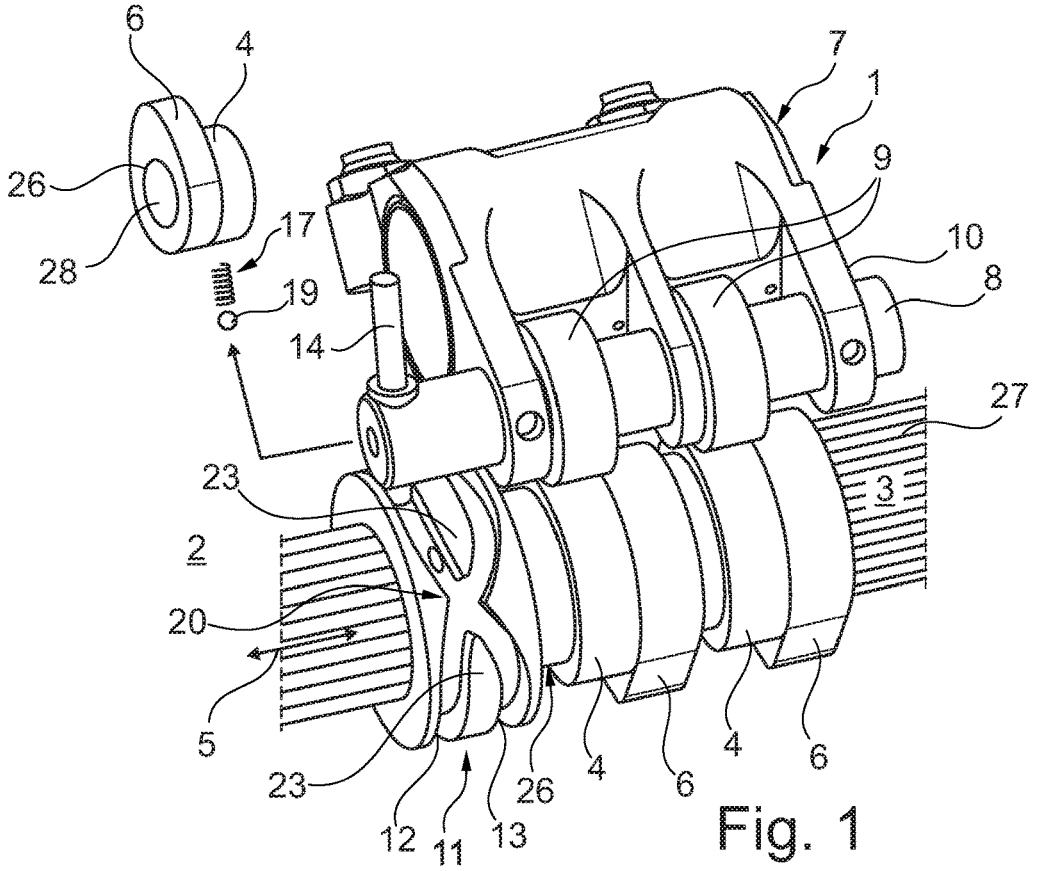
FIG. 1 shows a view of a valve train according to the invention.

According to the FIGS. 1, 6 and 7 to 9, a valve train 1 of an internal combustion engine 2 which is not shown in more detail according to the invention comprises a camshaft 3 having a first cam 4 and a second cam 6 that is axially adjacent thereto in the axial direction 5. The first cam 4 and the second cam 6 are shiftably arranged on a cam sleeve 26 (see also FIGS. 5 and 10) that is adjustable between at least two positions on the camshaft 3, wherein on the cam sleeve 26 additionally a guide contour 11 with two guide tracks 12, 13 intersecting one another x-like are arranged. Here, the cam sleeve 26 can be formed in one piece together with the cams 4, 6 and the guide contour 11, in particular in monobloc form.

Figure 8:
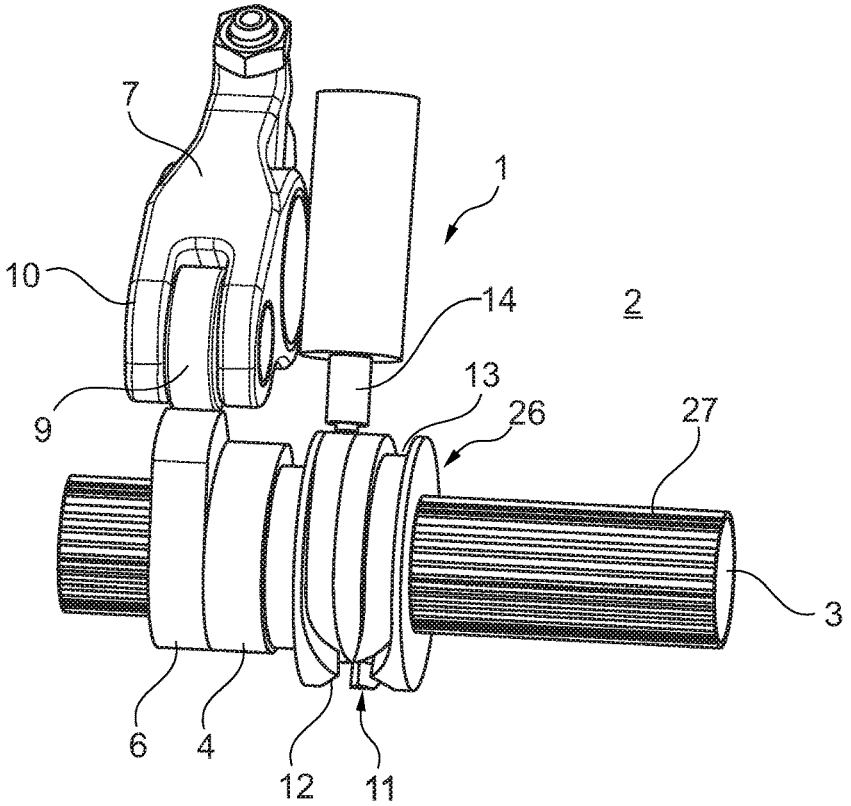
FIG. 8 shows an alternative representation to FIG. 1 with separately arranged control pin.

Likewise provided can be a rocker lever assembly 7 having a pin 8 (see FIG. 1) that is fixed in the axial direction 5, on which at least one cam follower 9, here two cam rollers 9, are axially fixed and rotatably mounted. The cam follower 9 can also be formed as a sliding element. Here, the pin 8 is mounted in associated bearing eyes 10 of the rocker lever assembly 7. In the pin 8, a control pin 14 is arranged according to FIG. 1 and FIG. 9, which optionally engages in the first or the second guide track 12, 13 (according to FIG. 1 in the second guide track 13) and thereby adjusts the cam sleeve 26 between its two positions. Obviously, the control pin 14 can also be arranged separately as is shown in FIG. 8. Here, the cam follower 9 or the cam rollers 9 interact in a first position of the cam sleeve 26 with the first cam 4 (see FIG. 1) and in a second position of the cam sleeve 26 with the second cam 6 (see FIGS. 8 and 9). Because of this, different valve opening times or a cylinder cut-off can also be realised for example.

According to a first alternative of the valve train 1 according to the invention, a first snap-in recess 15 and a second snap-in recess 16 (see FIGS. 2 and 3 and 10) arranged adjacent thereto in the axial direction 5 is now provided on the camshaft 3. Provided, furthermore, is a snap-in device 17 having a snap-in element 19 that is spring-preloaded into the first, the second or a third snap-in recess 18, which fixes the cam sleeve 26 and thereby the cams 4, 6 in the first position or the second position, provided the snap-in element 19 engages in the first or second snap-in recess 15, 16. Here, the snap-in device 17 can be arranged in the region of the guide contour 11 or in the region of the cams 4, 6 (see detail representation in FIGS. 1 and 10).

Figure 9:
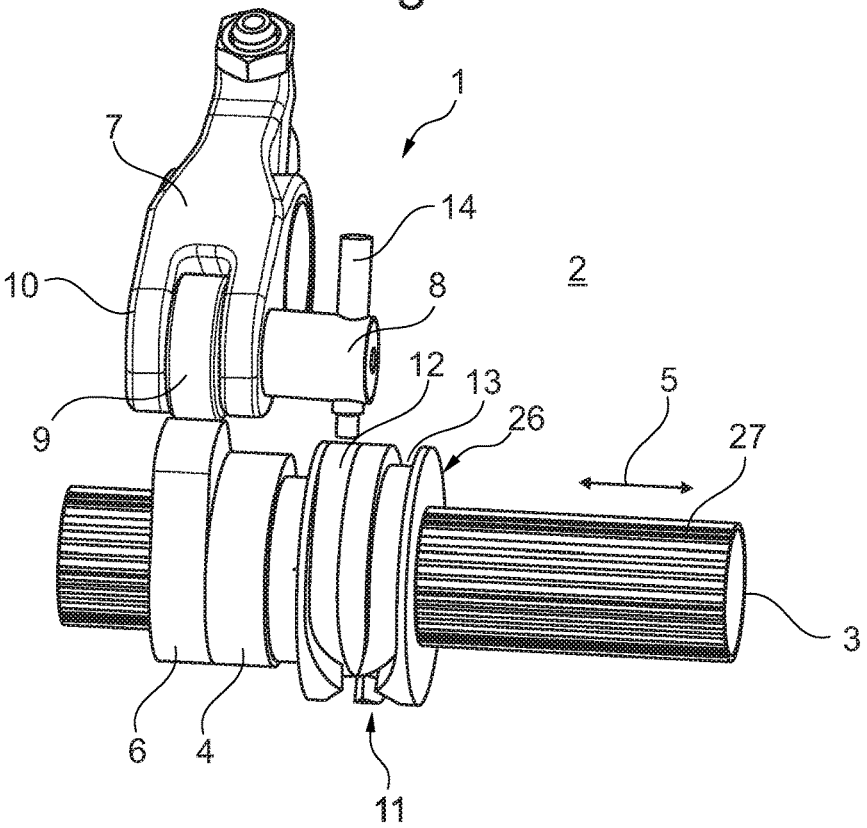
FIG. 9 shows a similar representation as in FIG. 1.

Viewing FIGS. 1, 8 and 9 further it is evident that the guide tracks 12, 13 intersect one another x-like in an intersection region 20. Between the first snap-in recess 15 and the second snap-in recess 16 arranged axially adjacent thereto, the previously mentioned third snap-in recess 18 is provided on the camshaft 3 according to the FIGS. 2, 3 and 10, wherein between the first and the third snap-in recess 15, 18 a first snap-in hump 21 and between the second and the third snap-in recess 16, 18 a second snap-in hump 22 are arranged, as a result of which the snap-in element 19 in the intersection region 20 engages in the third snap-in recess 18 and is guided in the same and because of this reliably guides the control pin 14 over the intersection region 20 without the same colliding with a land 23 separating the two guide tracks 12, 13 or threading into the wrong guide track 12, 13 and because of this a changeover is not possible. With the third snap-in recess 18 according to the invention it is thus possible to employ an installation space-optimised guide contour 11 with two guide tracks 12, 13 intersecting one another and because of this create not only an installation space-optimised but also an assembly-friendly and cost-effective valve train 1.

Figure 2:
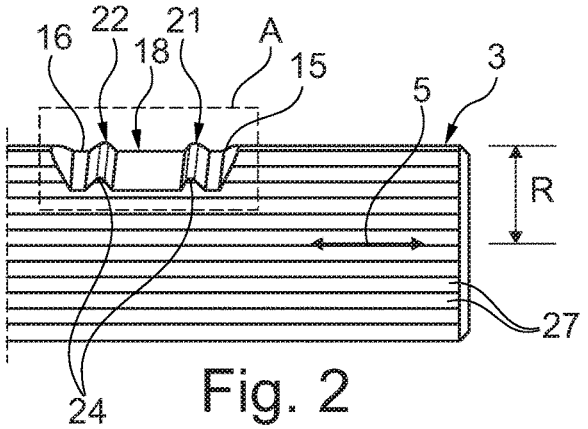
FIG. 2 shows a view of a camshaft according to the invention.
Figure 3:
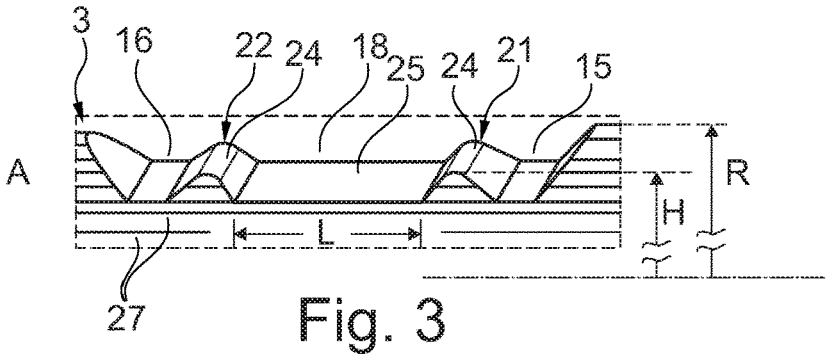
FIG. 3 shows a detail representation A from FIG. 2.
Figure 4:
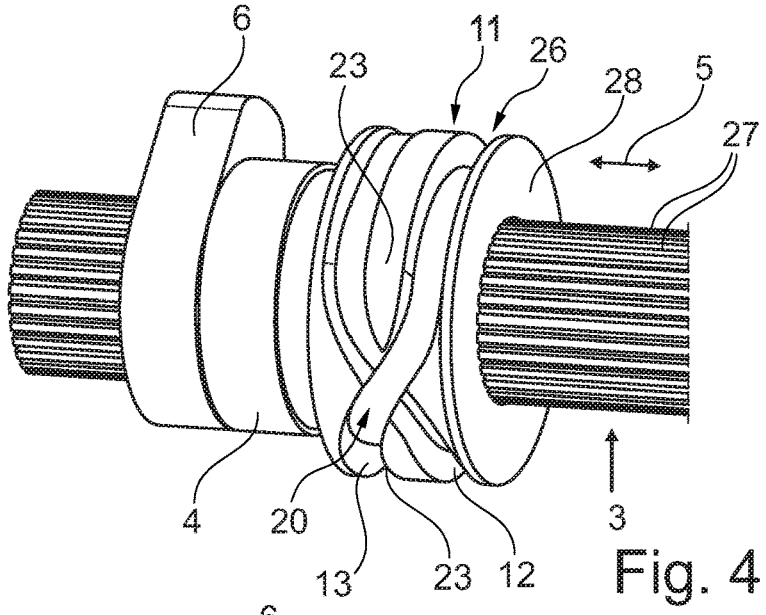
FIG. 4 shows a detail view of the camshaft according to the invention with cam sleeve arranged thereon.
Figure 10:
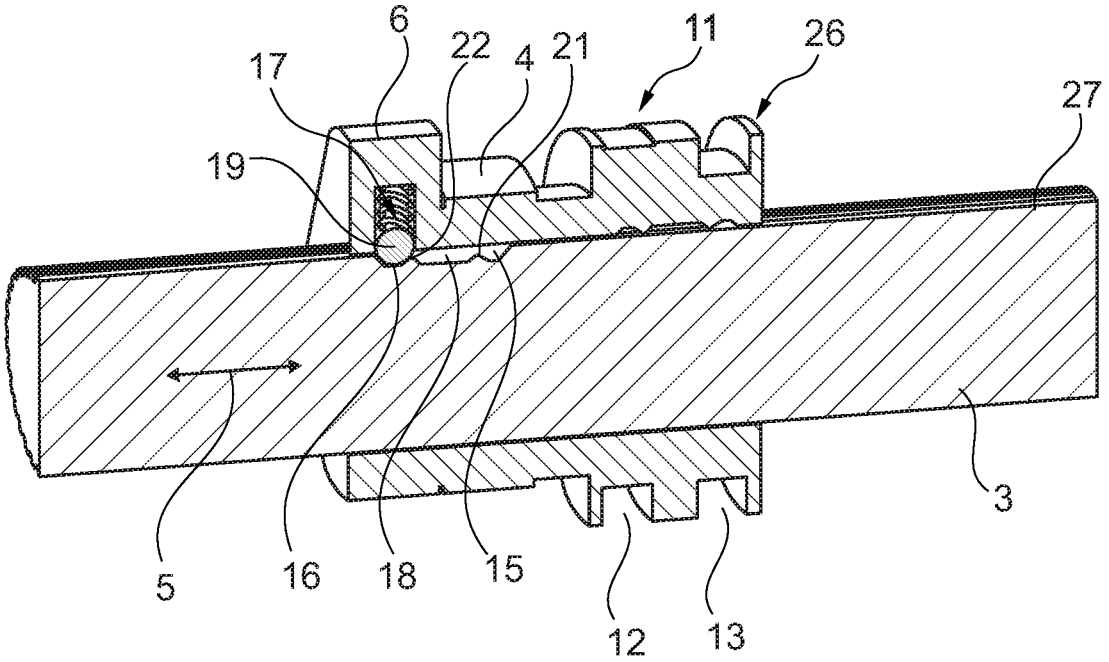
FIG. 10 shows a sectional representation through a first embodiment of the camshaft.

Viewing the FIGS. 2, 3 and 10 it is evident that the first snap-in hump 21 and/or the second snap-in hump 22 have a rounded dome 24. Because of this, a smooth transition between the individual snap-in recesses 15, 18, 16 is possible. Alternatively, it can obviously also be provided that the domes 24 are designed pointed, as a result of which a quick overcoming of the dome 24 is made possible and an axial force support for shifting the cam sleeve 26 in the axial direction 5 can be provided, provided the dome 24 is overcome.

The flank of the first snap-in hump 21 falling towards the third snap-in recess 18 has a steeper slope according to the FIGS. 2 and 3 than a flank falling towards the first snap-in recess 15, as a result of which a higher support force acting in the axial direction 5 for shifting the cam sleeve 26 in the axial direction 5 can be provided. In the same way, the flank of the second snap-in hump 22 falling towards the third snap-in recess 18 also has a steeper slope than the flank falling towards the second snap-in recess 16. Viewing the individual snap-in recesses 15, 18, 16 according to the FIGS. 2 and 3 further it is evident that the third snap-in recess 18 has a greater axial length L than the first snap-in recess 15 and the second snap-in recess 16, as a result of which a smoother adjusting of the cam sleeve 26 in the intersection region 13 and at the same time a reliable guiding of the control pin 14 in the intersection region 20 is made possible. Through the significantly shorter axial length of the first and second snap-in recess 16, a tight axial guidance of the snap-in element 19 and thus a reliable guidance of the cam follower on the respective cam profile of the first or the second cam 4, 6 is thereby enforced. A radial height H of the first and/or second snap-in hump 21, 22 is smaller than a radius R of the cam sleeve 26, as a result of which the switching operation and the shifting of the cam sleeve 26 can be facilitated. The flanks falling towards the third snap-in recess 18 on the first or second snap-in hump 21, 22 can, as drawn in, be formed linearly or concavely and thus merge without a bend into a bottom 25 of the third snap-in recess 18.

Viewing FIGS. 1 to 10 it is evident that the camshaft 3 on its outer surface at least in the region of the cam sleeve 26 comprises axial grooves 27 which interact with internal teeth 28 (see FIGS. 4 and 5) arranged on an internal surface of the cam sleeve 26 and thereby make possible a guided axial shifting of the cam sleeve 26 on the camshaft 3. The axial grooves 27 on the camshaft 3 can form an external gearwheel profile which interacts with an internal gearwheel profile on the cam sleeve 26 formed complementarily thereto in such a manner that the cam sleeve 26 is shiftably arranged on the camshaft 3 in the axial direction 5 but non-rotatably on the same, i.e. is rotatable only together with the same. Generally, an anti-rotation device can also be provided which prevents a rotation of the cam sleeve 26 relative to the camshaft 3, but makes possible an axial shifting of the cam sleeve 26 on the camshaft 3. Such an anti-rotation device can also comprise a feather keyway, a polygon profile and the like.

Besides the entire valve train 1, the camshaft 3 according to the invention for such a valve train 1 is to be protected as well, wherein the same according to FIGS. 2 and 3 comprises the previously described first snap-in recess 15 and the second snap-in recess 16 arranged axially adjacent thereto and a third snap-in recess 18 arranged in between in the axial direction 5. Between the first and the third snap-in recess 15, 18 a first snap-in hump 21 is arranged, while between the second and the third snap-in recess 16, 18 a second snap-in hump 22 is arranged. The first, second and third snap-in recess 15, 16, 18 in this case are formed as a relief cut. The first snap-in recess 15, the third snap-in recess 18 and the second snap-in recess 16 are arranged one behind the other in the axial direction 5 and only separated by the relevant snap-in humps 21, 22. With the camshaft 3 according to the invention it is possible for the first time to use an installation space-optimised guide contour 11 with two guide tracks 12, 13 intersecting one another in an intersection region 20 without it having to be feared that in the process, during an adjusting of the cam sleeve 26 from its first into its second position and thus from a change of following of the at least one cam follower 9 from the first to the second cam 4, 6 or vice versa, a threading into the wrong guide track 12, 13 or a collision with a land separating the two guide tracks 12, 13 has to be feared.

With the camshaft 3 according to the invention the first snap-in hump 21 and/or the second snap-in hump 22 have a rounded dome 24, by way of which a smooth transition between the individual snap-in recesses 15, 18, 16 is made possible. In addition, the first and/or second snap-in hump 21, 22 can be hardened, heat-treated and/or coated. By way of hardening, the wear resistance can be increased in particular, as also by means of a coating, for example a DLC coating.

Figure 5:
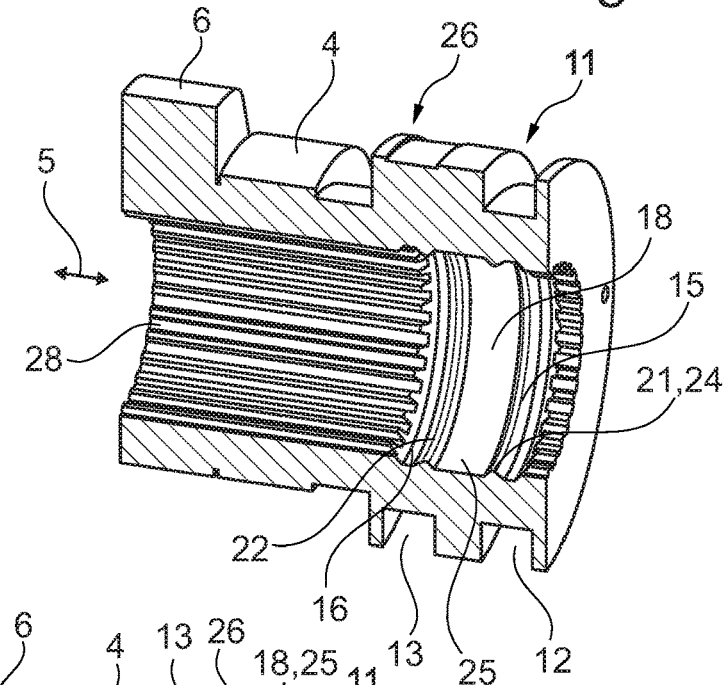
FIG. 5 shows a sectional representation through a cam sleeve according to the invention.
Figure 6:
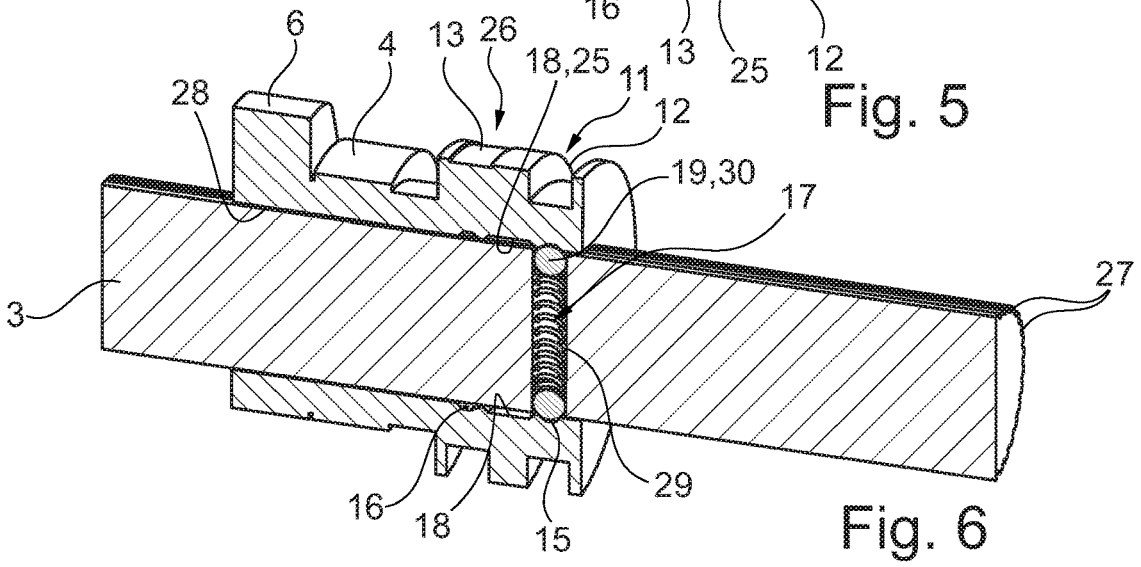
FIG. 6 shows a sectional representation through a cam sleeve according to the invention on a camshaft.
Figure 7:
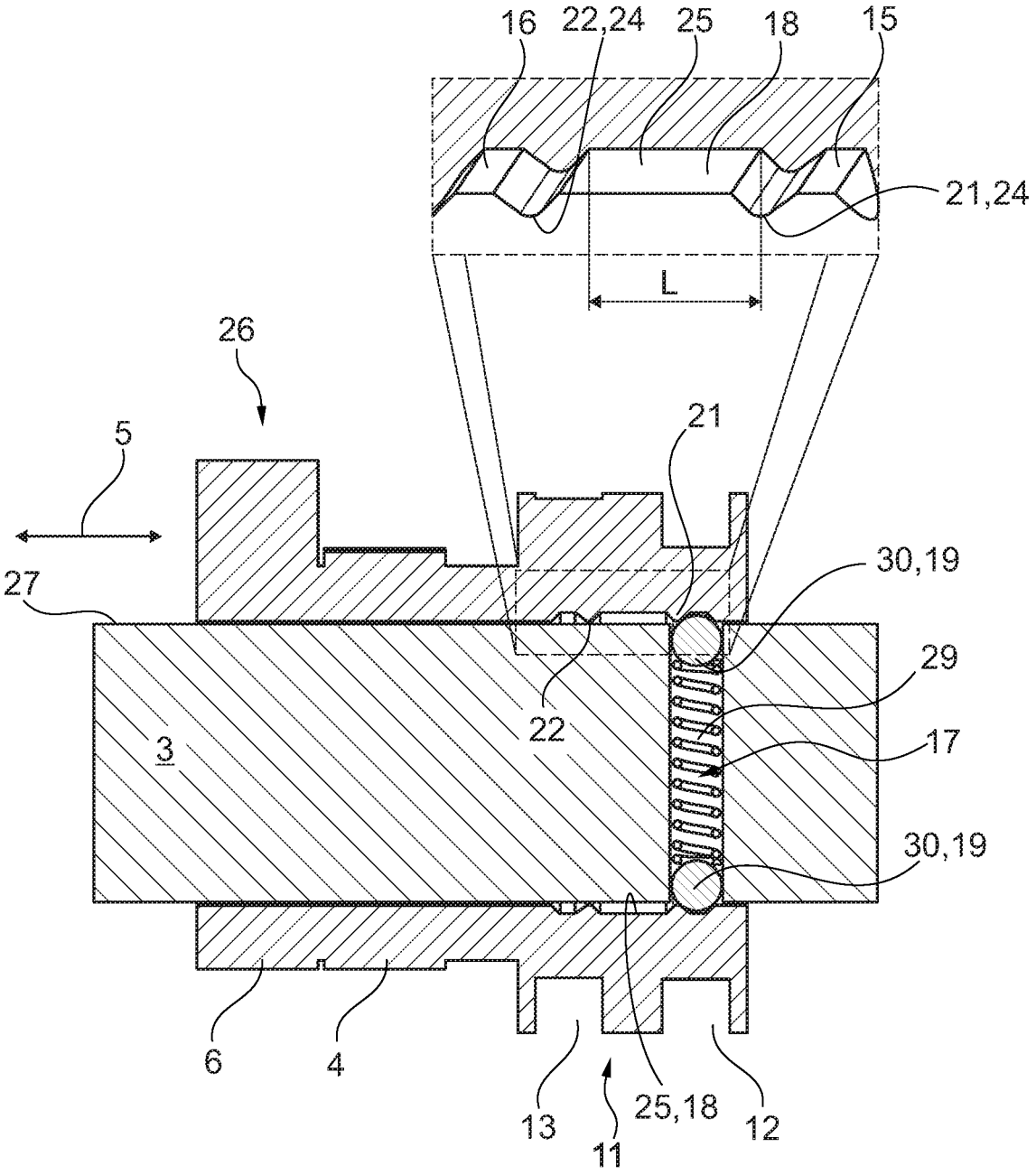
FIG. 7 shows a representation as in FIG. 6 with additional detail representation.

According to the second alternative of the valve train 1 according to the invention or of the cam sleeve 26 according to the invention, the same has a first snap-in recess 15 and a second snap-in recess 16 arranged axially adjacent thereto, wherein between the first snap-in recess 15 and the second snap-in recess 16 a third snap-in recess 18 is provided, wherein between the first and the third snap-in recess 15, 18 a first snap-in hump 21 and between the second and the third snap-in recess 16, 18 a second snap-in hump 22 are arranged (see FIGS. 5 to 7).

Here, the first snap-in recess 15, the second snap-in recess 16 and the third snap-in recess 18 can be formed as annular grooves on the internal surface of the cam sleeve 26 which are open towards the inside, as is shown in FIG. 5, wherein the snap-in device 17 is arranged in an opening crossing the camshaft 3 and comprises a coil spring 29 as well as two spheres 90 as snap-in elements 19. By way of this, both the snap-in recesses 15, 16, 18 and also the snap-in device 17 can be produced in a technically simple and cost-effective manner.

Viewing FIG. 7 it is evident that the first snap-in hump 21 and/or the second snap-in hump 22 has/have a rounded dome 24. By way of this, a smooth transition between the individual snap-in recesses 15, 18, 16 is possible. Alternatively, it can also be obviously provided that the domes 24 are formed pointed as a result of which a quick overcoming of the dome 24 is made possible and an axial force support for shifting the cam sleeve 24 in the axial direction 5 can be provided, provided the dome 24 is overcome. With the cam sleeve 26 according to the invention, the first and/or second snap-in hump 21, 22 can also be additionally hardened, heat-treated and/or coated.

Purely theoretically, a shiftability of the cam sleeve 26 and an additional shifting of the pin 8 is also conceivable, which makes possible further configurations in terms for example of being able to switch between three cam contours, wherein one contour can be utilised for a cylinder cut-off.

The invention claimed is:

1. A valve train of an internal combustion engine, the valve train comprising:

a camshaft;

a cam sleeve non-rotatably arranged on the camshaft, the cam sleeve configured to be axially adjusted between at least a first position and a second position with respect to the camshaft, the cam sleeve including:

a first cam and a second cam arranged adjacent to the first cam; and a guide contour including a first guide track and a second guide track; and a rocker lever assembly including a pin extending parallel to the camshaft, the pin including:

at least one cam follower; and a control pin extending perpendicularly through the pin, the control pin configured to alternately engage the first guide track and the second guide track so as to adjust the cam sleeve between the first and second positions;

wherein the at least one cam follower engages the first cam when the cam sleeve is in the first position, and the at least one cam follower engages the second cam when the cam sleeve is in the second position;

wherein a first snap-in recess, a second snap-in recess, and a third snap-in recess are axially aligned on an outer surface of the camshaft;

wherein the third snap-in recess is axially arranged between the first and second snap-in recesses;

wherein a first snap-in hump is arranged between the first snap-in recess and the third snap-in recess, and a second snap-in hump is arranged between the second snap-in recess and the third snap-in recess;

wherein the cam sleeve further includes a snap-in device arranged in an internal surface of the cam sleeve, the snap-in device configured to alternately bias a snap-in element into engagement with the first and second snap-in recesses so as to hold the cam sleeve in the first position and the second position, respectively;

wherein the first and second guide tracks intersect each other in an intersection region of the guide contour; and wherein the snap-in element engages the third snap-in recess when the control pin is in the intersection region.

2. The valve train according to claim 1, wherein at least one of the first snap-in hump and the second snap-in hump has a rounded or a pointed dome.

3. The valve train according to claim 1, wherein:

a first flank of the first snap-in hump falling towards the third snap-in recess has a steeper slope than a second flank of the first snap-in hump falling towards the first snap-in recess; and/or a first flank of the second snap-in hump falling towards the third snap-in recess has a steeper slope than a second flank of the second snap-in hump falling towards the second snap-in recess.

4. The valve train according to claim 1, wherein:

an axial length of the third snap-in recess is greater than an axial length of the first snap-in recess and an axial length of the second snap-in recess; and/or a radial height of at least one of the first snap-in hump and the second snap-in hump is less than a radius of the camshaft.

5. The valve train according to claim 1, wherein at least one of the first snap-in hump and the second snap-in hump is at least one of hardened, heat-treated, and coated.

6. The valve train according to claim 1, wherein:

the cam sleeve is non-rotatably arranged on the camshaft via an anti-rotation device; and/or the camshaft is a splined shaft configured to interact with internal teeth arranged on an internal surface of the cam sleeve.

7. A camshaft for a valve train, the camshaft comprising:

a first snap-in recess, a second snap-in recess, and a third snap-in recess axially aligned on an outer surface of the camshaft, wherein the third snap-in recess is axially arranged between the first snap-in recess and the second snap-in recess, and wherein a first snap-in hump is arranged between the first snap-in recess and the third snap-in recess, and a second snap-in hump is arranged between the second snap-in recess and the third snap-in recess.

8. The camshaft according to claim 7, wherein at least one of the first snap-in hump and the second snap-in hump has a rounded or a pointed dome.

9. The camshaft according to claim 7, wherein:

a first flank of the first snap-in hump falling towards the third snap-in recess has a steeper slope than a second flank of the first snap-in hump falling towards the first snap-in recess; and/or a first flank of the second snap-in hump falling towards the third snap-in recess has a steeper slope than a second flank of the second snap-in hump falling towards the second snap-in recess.

10. The camshaft according to claim 7, wherein:

an axial length of the third snap-in recess is greater than an axial length of the first snap-in recess and an axial length of the second snap-in recess; and/or a radial height of at least one of the first snap-in hump and the second snap-in hump is less than a radius of the camshaft.

11. The camshaft according to claim 7, wherein at least one of the first snap-in hump and the second snap-in hump is hardened, heat-treated, and coated.

12. The valve train according to claim 7, wherein the camshaft is configured to engage a cam sleeve in an axially adjustable manner; and wherein:

the camshaft is further configured to non-rotatably engage the cam sleeve via an anti-rotation device; and/or the camshaft is a splined shaft configured to interact with internal teeth arranged on an internal surface of the cam sleeve.

* * * * *